United States Patent [19]

Costa et al.

[11] Patent Number: 4,667,947

[45] Date of Patent: May 26, 1987

[54] FEED DEVICE FOR A PRINTER OR TYPEWRITER

[75] Inventors: Jorge Costa; Wolfgang Reichel, both of Yverdon, Switzerland

[73] Assignee: Hermes Precisa International S.A., Yverdon, Switzerland

[21] Appl. No.: 616,148

[22] Filed: Jun. 1, 1984

[30] Foreign Application Priority Data

Jun. 3, 1983 [CH] Switzerland ..... 3057/83

[51] Int. Cl.[4] ..... B65H 3/44

[52] U.S. Cl. ..... 271/9; 271/22; 271/121; 271/246; 400/624; 400/625

[58] Field of Search ..... 271/3.1, 9, 10, 16, 271/19, 21, 22, 65, 114, 118, 245, 246, 303; 400/625, 629, 624

[56] References Cited

U.S. PATENT DOCUMENTS

| | | | |
|---|---|---|---|
| 1,561,821 | 11/1925 | Bessat et al. | 271/19 |
| 2,366,206 | 1/1945 | Metzner | 400/624 |
| 3,630,519 | 12/1971 | Spear | 271/246 |
| 3,652,083 | 3/1972 | Bosshardt | 271/246 |
| 4,023,792 | 5/1977 | Punnett et al. | 271/22 |
| 4,084,805 | 4/1978 | Simpson | 400/625 |
| 4,113,244 | 9/1978 | Ruenzi | 271/121 |
| 4,221,374 | 9/1950 | Koch et al. | 400/625 |
| 4,285,607 | 8/1981 | Steinhilber | 271/9 |
| 4,371,276 | 2/1983 | Mitrovich et al. | 400/625 |
| 4,407,597 | 10/1983 | Kapp | 400/625 |
| 4,447,176 | 5/1984 | Euteneuer et al. | 400/625 |
| 4,502,805 | 3/1985 | Humbs | 400/625 |

*Primary Examiner*—George E. A. Halvosa
*Assistant Examiner*—Matthew C. Graham

[57] ABSTRACT

A sheet feed device for a printer or typewriter having a plurality of cassettes supporting stacks of sheets to be printed, a sheet removal mechanism associated with each cassette for removing a sheet from the cassette and positively driving the removed sheet to a position for feeding it into the printer, and a selection mechanism for actuating a selected one of the sheet removal mechanism.

13 Claims, 4 Drawing Figures

FEED DEVICE FOR A PRINTER OR TYPEWRITER

This invention relates to an individual sheet feed device for a printer or a typewriter, comprising supports on which the sheets to be printed are held by holding elements in approximately vertical stacks and, associated with each of the supports, a removal mechanism intended to remove a sheet from the stack and introduce it into the printer, this mechanism comprising separation means for the top sheet of the stack exhibiting at least one roller intended to move said sheet by friction in a first direction against gravity to disengage it from the holding elements, these separation means being able to be disengaged from the sheet to make possible the free fall of this latter.

Devices of this type are already known. Patent application DE-OS No. 2,735,223 describes a device comprising a drive element that can move by friction the top sheet of an approximately vertical stack upward to disengage it from under a list holding the sheets elastically against a support. The sheet striking against the upper edge of the support then forms a buckle in the sheet. When the drive element is disengaged from the sheet, this latter drops in free fall on the platen of the printer which comprises at this place a counterpressure roller for driving the sheet.

In this device, the sheet makes its drop while being subjected to elastic forces due to the presence of the buckle. If the resulant of these forces is not exactly directed in a vertical direction, the sheet drops obliquely to arrive in an eccentric position on the platen. Even if the drop is made vertically, there is no exact position in which the sheet is stopped and taken by the drive of the platen. Consequently, the sheet cannot be positioned precisely on the platen in relation to the writing device.

The device according to this application has as its object to eliminate these drawbacks and, for this purpose, it is characterized in that the separation means are made to move said sheet in a second direction opposite the first above the holding elements and wherein each of the removal mechanisms comprises a retractable alignment stop intended to stop the sheet during its free fall in a predetermined position, each of the removal mechanisms comprising a transport device made to introduce the sheet from this predetermined position into the printer.

The accompanying drawing represents, by way of example, an embodiment of the device, object of the invention.

Figure 1:
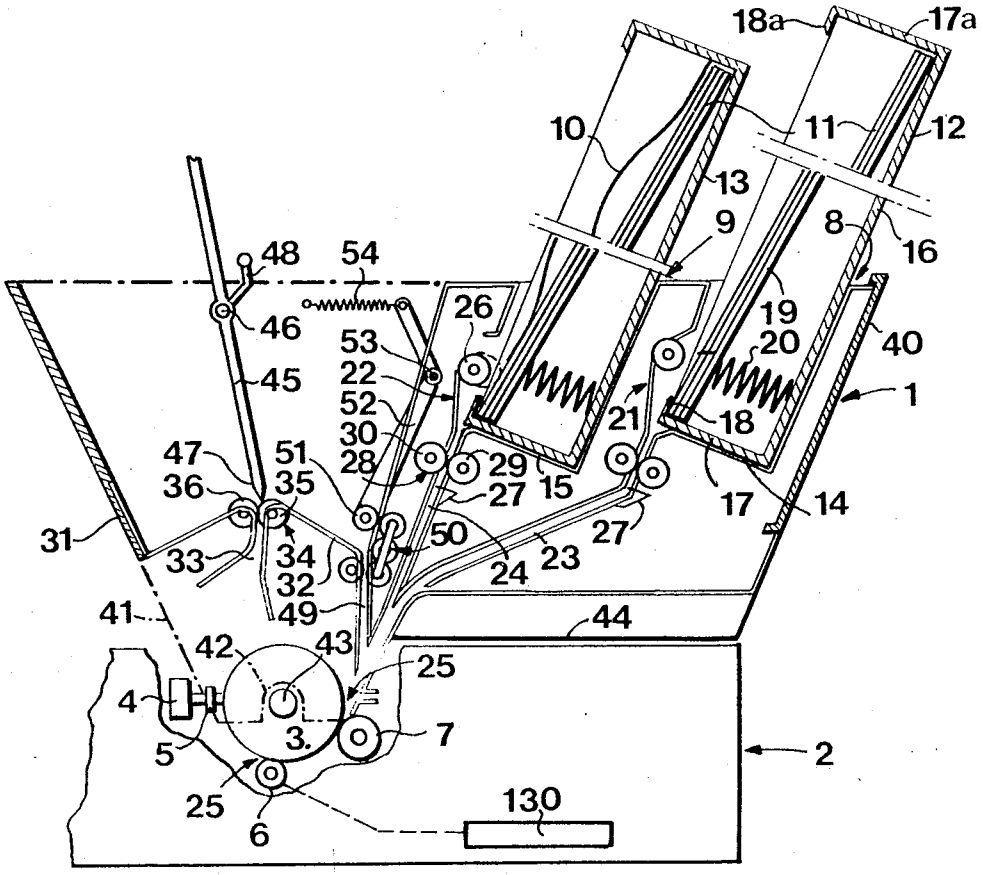
FIG. 1 is a side view in section showing the entire unit of the device mounted on a printer.

With reference to FIG. 1, sheet feed device 1 is mounted on a printer 2 or typewriter comprising a platen 3 and a mobile carriage 4 that can move along the platen and carrying a writing device 5 such as a dot matrix head or daisy wheel. A drive shaft 6, connected to a drive motor, preferably a stepping motor, not shown, drives platen 3. Counterpressure rollers, only one of which, 7, is shown, are pulled elastically against the platen and constitute a drive mechanism 25 making it possible to make a sheet of paper, introduced into the printer, advance in a known way.

Feed device 1 comprises a frame 40 whose side walls 41 exhibit notches 42 fitting on shaft 43 of platen 3. Base 44 of the frame rests on the back part of printer 2. Feed device 1 comprises supports 8 and 9 on which sheets 11 to be printed are stored. These supports comprise cassettes 12 and 13, that can be placed on holding plates 14, 15 and can be removed from these positions. Cassettes 12, 13, rectangular in shape, comprise a bottom 16 and side walls 17, 17*a*. These latter have holding elements 18, 18*a* in their upper part, in the form of rims intended to hold sheets 11 placed on a support plate 19. This plate 19 is pulled in its lower part by a spring 20 in the direction of holding elements 18. At its upper part plate 19 is held approximately in contact with bottom 16.

A removal mechanism 21, 22, is associated with each of supports 8, 9 and serves to shift and remove the top sheet from the stack of sheets 11 and to transport it by a channel 23, 24 to paper drive device 25. As described in detail below, this mechanism is made to transport the sheet upwards with the aid of a roller 26. The lower edge of the sheet is then disengaged from holding elements 18 and the sheet, hitting against the upper wall 17*a* of the cassette, forms a buckle 10. Roller 26 then drives the sheet in the opposite direction. The lower edge passes above holding elements 18 and buckle 10 is eliminated. Roller 26 is then disengaged from the sheet which falls freely against an alignment stop 27. A transport device 28, consisting of two rollers 29, 30, is then activated to introduce the sheet in a controlled fashion into printer 2 where it is taken by drive device 25.

Device 1 further comprises two supports 31 and 32 intended to store the printed sheets. After printing, these sheets pass into exit channel 33 where they are carried by transport device 34 also consisting of two drive rollers 35 and 36 to be placed in normal order on support 31 or in reverse order on support 32. Wall 45 separating the two supports is mounted for this purpose to rotate around a pivot 46. A handle 48 allows this wall 45 to be locked in a given position. Lower edge 47 of wall 45 exhibits two guide surfaces guiding the sheets as they exit channel 33 either to the left on support 31 or to the right on support 32.

Support 32 can also be used as a support for feeding envelopes to be printed. It has for this purpose, in its lower part, a channel 49 suitable for guiding the envelopes toward platen 3. Removal mechanism 50 is placed at the lower part of support 32 and permits shifting and carrying of the lowest envelope of a stack placed on support 32. The stack of envelopes is held by rollers 51 placed on a crossbar fastened to on end of a bent lever 52 mounted to rotate around a pivot 53. Rollers 51 are pulled by a spring 54 in the direction of the back wall of support 32. In case the support is used as a container for the sheets already printed, rollers 51 rest on this wall in such a way as to obstruct entry from channel 49.

Figure 2:
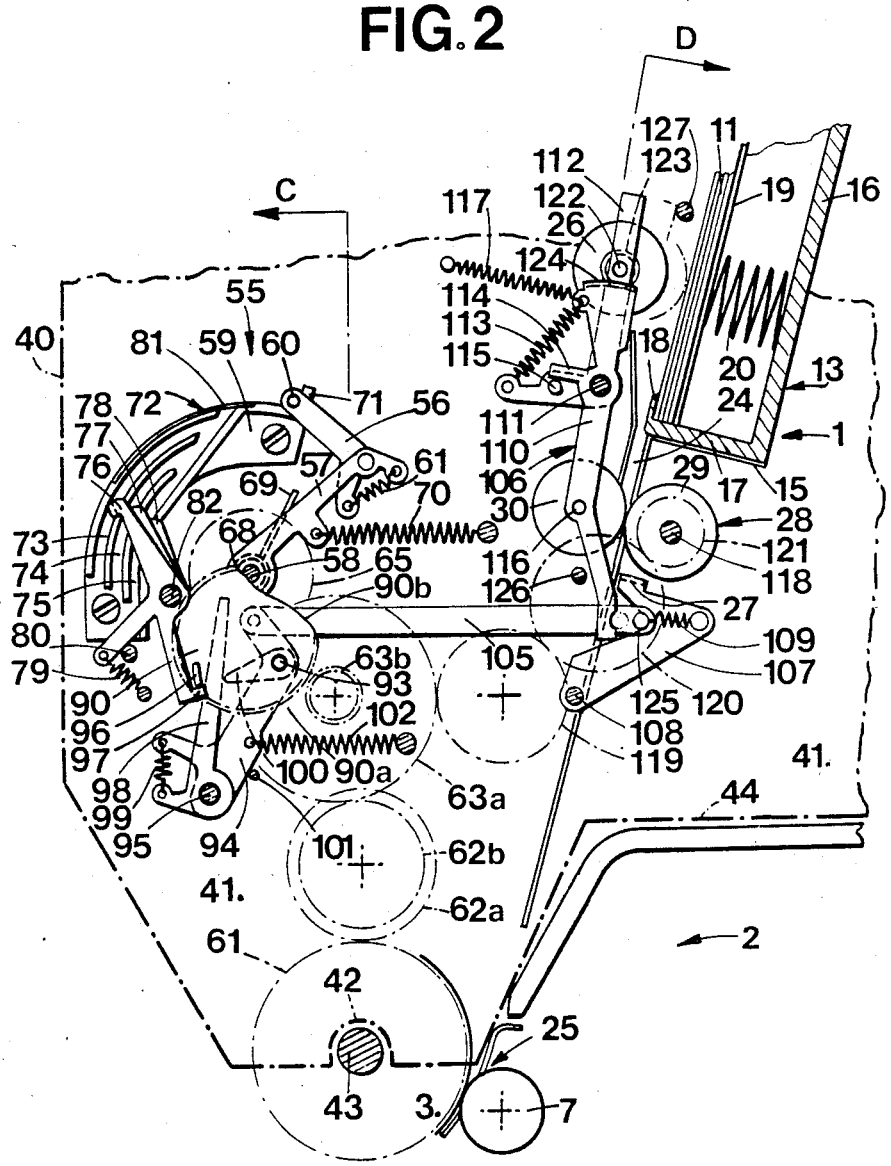
FIG. 2 is a side view illustrating the features of the device.
Figure 3:
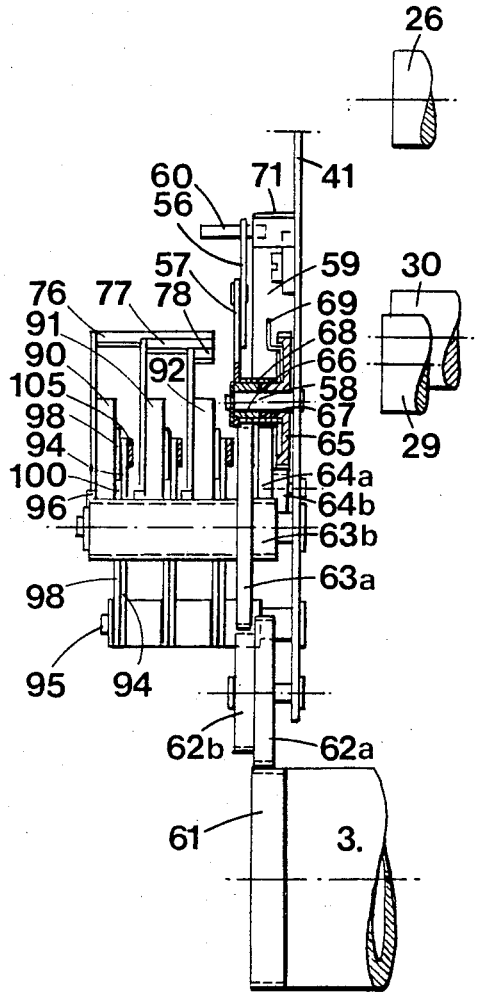
FIG. 3 is a view in section along C of FIG. 2.
Figure 4:
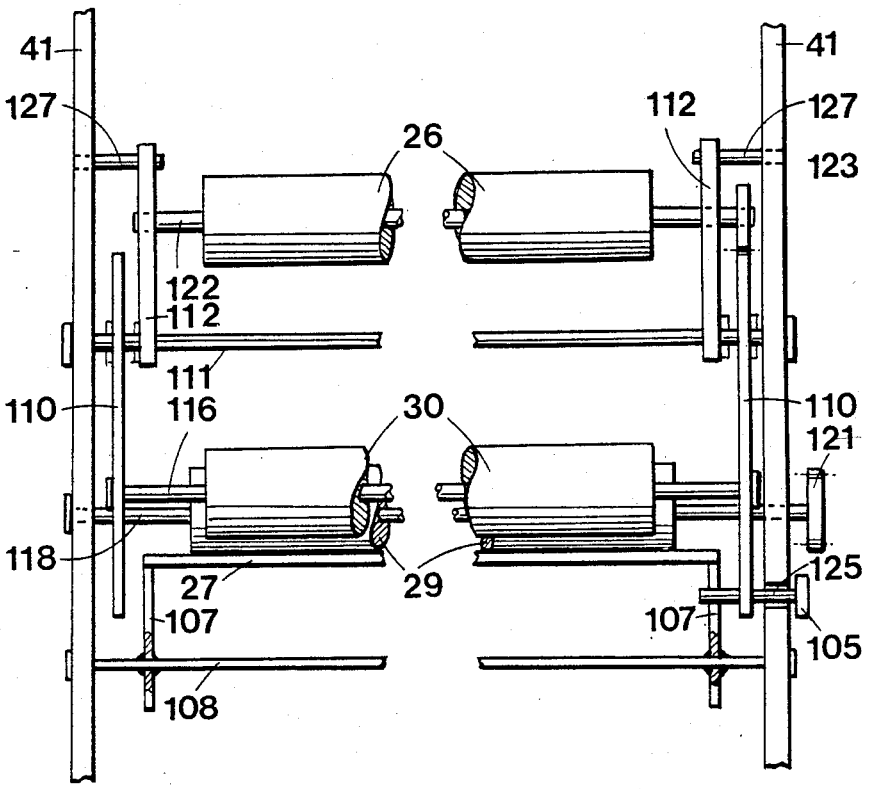
FIG. 4 is a view in section along D of FIG. 2, some of the elements not being shown for the sake of clarity.

In reference to FIGS. 2 to 4, the feed device comprises a selection mechanism 55 intended to activate at the user's choice one of removal mechanisms 21, 22, 50. This selection mechanism 55 comprises a selection lever 56 mounted to rotate at one of the ends of a selection arm 57 whose other end is fixed to a sleeve 66 mounted to turn around a shaft 58. A guide part 59 engages a pin 60 connected to the end of selection lever 56. A spring 61 connects lever 56 to arm 57 to pull pin 60 against guide part 59. Arm 57 is driven by platen 3 as a result of a series of gears 61 to 65 so that arm 57 rotates around shaft 58 in the same direction as platen 3 rotates around shaft 43. Toothed wheel 65, mounted to rotate around shaft 58, comprises a sleeve 67 connected by an overriding clutch to sleeve 66 fixed to the selection arm 57. The clutch consists of a spring clutch 68. One end of the spiral spring of clutch 68 is fastened rigidly to sleeve 66, while the other end is wound around sleeve 67 and terminates in an extension 69. Selection arm 57 is pulled by a spring 70 to a rest position in which pin 60 is held against stop 71 of guide part 59. The winding of the spiral spring of clutch 68 is such that sleeves 66 and 67 are coupled, when wheel 65 turns left. On the other hand, sleeve 67 can continue to turn right, when selection lever 56 is engaged by stop 71. In the case shown in FIG. 2, this winding of spring 68 should be righthanded. Extension 69 of the spring can come in contact with a stop consisting of a shaft 82 and is locked by this latter when toothed wheel 65 turns left. This locking of extension 69 has the effect of slightly opening spring 68 wound around sleeve 67 and of uncoupling selection arm 57 from drive device 61 to 65.

Guide part 59 of the selection mechanism comprises a selection slide 72, along which pin 60 is guided when the selection lever turns left, and a number of guide tracks 73 to 75 equal to the number of removal mechanisms 21, 22, 50.

Selection slide 72 and guide tracks 73 to 75 consist of sectors of concentric circles. The axis of rotation of selection arm 57 is merged with the center of these concentric circles. Guide tracks 73 to 75 comprise openings communicating with selection slide 72 so that pin 60 can follow one of the guide tracks when lever 56 is driven in the opposite direction. Therefore, the amplitude of the movement of lever 56 in the left direction determines the guide track followed by pin 60. The feed device comprises, associated with each of the guide tracks, a removal control part, such as rockers 76 to 78. These rockers 76 to 78 are mounted to rotate on shaft 82 and have a flange adapted to be engaged by the pin 60, when this latter takes the corresponding guide track. A rotation of one of the rockers causes the start of the corresponding removal mechanism. Pulled by a spring 79, the rocker then falls back in its rest position determined by stop 80.

To guide selection lever 56 to its rest position, guide tracks 73 to 75 meet and communicate with selection path 72 by an opening covered by an elastic blade 81 to permit exit of pin 60 in the direction of the rest position but preventing any entry of this pin 60 when it is moved from right to left.

Each of the removal mechanisms associated with the paper supports comprises a cam 90 to 92. This cam is mounted to rotate around an eccentric pivot 93 on a bent arm 94 that can rotate around shaft 95. A stop 96 fixed to cam 90 engages flange 97 on the end of rocker 76 to prevent cam 90 from swinging around pivot 93. A spring 102 pulls bent arm 94 against a stationary stop 101 so that the periphery of cam 90 occupies a position close to the periphery of toothed wheel **63*b*, but does not touch this periphery when flange 97 is in contact with stop 96. Each of the removal mechanisms further comprises a lever 98 pulled by a spring 99, set between lever 98 and bent arm 94, against a part 100 fixed to cam 90 to rotate cam 90 when flange 97 is disengaged from stop 96**.

The periphery of cam 90 comprises a first portion **90*a* consisting of teeth adapted to engage toothed wheel 63*b* and a second smooth portion 90*b* that can slide on these teeth under the action of spring 102**.

The end of bent arm 94 is coupled to a pullrod 105 controlling the sheet separation means and the positioning of alignment stop 27. This alignment stop consists of a comb-shaped part fastened between two arms 107 rotating around a shaft 108 fastened to the frame. A pin 125 fixed to pullrod 105, engaged in a slot of wall 41, is connected by a spring 109 to one of arms 107.

Separation means 106 comprise, in the proximity of two side walls 41, a lever 110 mounted on a shaft 111 fastened to the frame and a bracket 112 also rotating around shaft 111. Lever 110 and bracket 112 are connected by a spring 113 pulling bracket 112 to a rest position determined by two stops 114 and 115 carried by lever 110 or bracket 112. Roller 30 of the removal mechanism is mounted to rotate on a shaft 116 held by levers 110. A spring 117 pulls levers 110 into such a position that roller 30 remains in contact with roller 29 fastened to a shaft 118 mounted on bearings solid with the frame. This shaft 118 is driven by platen 3 by gears 119 to 121 so that roller 29 and platen 3 turn in the opposite direction.

Roller 26 comprises a shaft 122 mounted on brackets 112. A toothed wheel 123 fixed to shaft 122 engages the teeth 124 a sector carried by one end of the one of levers 110. The other end of this lever 110 is adapted to engage in 125 fixed to pullrod 105 to control rotation of lever 110 around shaft 111. The device further comprises a stop 126 intended to fix the exact position of alignment stop 27 during its positioning and of stops 127 to limit the rotating of bracket 112 around shaft 111.

Rollers 26, 29, and 30 are covered with elastomer to assure friction drive of the sheets of paper. The sheet feed device can be adapted to any printer or typewriter with a control unit 130 that can precisely control the drive of the platen in both directions.

The device functions as follows. When printer control unit 130 receives the order to introduce a given type of sheets stacked on supports 8, 9 and 32, it orders a rotation of platen 3 in a direction opposite the introduction. Platen 3, by gears 62 to 65, drives arm 57 and selection lever 56 in a left rotation. The amplitude of this left rotation determines which of guide tracks 73 to 75 will be followed by pin 60. Therefore, this amplitude constitutes the selection criterion. Gears 62 to 65 were chosen so that the selection is made for rotations of the platen between 2 and 2.5 turns in the direction opposite the introduction of the paper. The direction of driving the platen is then reversed and pin 60 follows one of tracks 73 to 75 to activate one of the removal control parts, consisting of rockers 76 to 78.

The selected rocker pivots around pivot 82 and disengages stop 96. By pressing on part 100, arm 98, pulled by spring 99, drives cam 90 in rotation, which because of its eccentricity comes in contact with toothed wheel **63*b*. This latter is driven in the same direction as platen 3 and drives cam 90 in rotation. Pullrod 105 is then moved a first time to the left in FIG. 2** and successively controls the following operations:

Positioning of alignment stop 27.

Rotating of lever 100 and bracket 112 around shaft 111 until bracket 112 comes in contact with stop 127.

Lever 110 continues its rotating movement and, by means of gears 123, 124, drives roller 26 to the left; in contact with the top sheet contained in cassette 13, this roller moves this sheet by friction upward over a distance of about a centimeter to disengage the lower edge of the sheet from under holding elements 18 of cassette 13, and to form a buckle 10 (see FIG. 1).

Cam 90, at this moment, has made a rotation of 180° and begins to move pullrod 105 to the right, controlling the following operations:

Lever 110 rotates in the opposite direction, driving roller 26 to the right, the latter transports the sheet of paper over elements 18 downward.

When the buckle is entirely reabsorbed and the sheet has been laid flat, roller 26 disengages from the sheet which falls freely on alignment stop 27.

Control unit 130 at this moment causes the drive motor to stop for about one second to assure that this fall occurs without hindrance.

After the start of the drive motor, smooth periphery 90*b* comes in contact with wheel 63*b* and slides over it.

Control unit 130 causes another stop of the drive motor. During this stop lever 110, pulled by spring 117, continues to rotate to allow closing of the two drive rollers 29 and 30. Pullrod 105 then causes retraction of alignment stop 27 under the effect of the pull of spring 102 acting on arm 94. Toothed periphery 90*a* then again comes in contact with toothed wheel 63*b*.

The drive motor is started for a period which is a function of the desired length of introduction of paper and controlled by unit 130. During this operation, cam 90 is driven by wheel 63*b* and bent arm 94 comes in contact with rest stop 101.

Lever 98, pulled by spring 99, rests on part 100 separating cam 90 a short distance from drive wheel 63*b*, and its stop 96 comes in contact with the flange 97 of rocker 76.

Since gears 62 to 65 are adapted so that it is necessary to make at least two turns of platen 3 in the direction opposite the paper advance for a selection to be effective and since the circumference of platen 3 corresponds approximately to half the length of a sheet of A4 size paper, it is possible in all cases to roll platen 3 back to correct or complete a previously printed line without thereby starting a new cycle of selection and removal.

Introduction of a sheet requires a single movement of platen 3 in a direction opposite to the paper advance to make the paper selection. The platen is then driven in the normal direction of introduction of the paper. The two stops of the drive motor controlled by unit 130 assure an unhindered drop of the paper and a closing of drive rollers 29, 30 in immobile position of the sheet. Of course, these two stops are not essential if the shape of cam 90 is chosen so that the paper has sufficient time to drop an alignment stop 27 before the roller 30 presses on roller 29 so that stop 27 is immediately retracted after the contact of the two transport rollers 29, 30.

Since buckle 10 is entirely reabsorbed before the sheet of paper can drop on alignment stop 27, the drop occurs normally. Transportation mechanism 28 takes this sheet in a predetermined position to introduce it in a controlled fashion into the printer, thus assuring an exact positioning of the sheet on platen 3.

We claim:

1. An individual sheet feed device for a printer or typewriter, comprising supports carrying stacks of sheets, said supports having holding elements for holding the sheets in substantially vertical stacks, a removal mechanism associated with each of said supports, said removal mechanism adapted to remove a sheet from the stack and to positively drive the removed sheet to a position for feeding said sheet into the printer, said removal mechanism including separation means for the top sheet of the stack having roller means adapted to engage and move said sheet by friction in a first direction against gravity to disengage said sheet from said holding elements and to positively drive the removed sheet in a second direction opposite the first over the holding elements to a position for feeding the sheet to a printer, said separation means being disengageable from said sheet allowing free fall of the sheet to said feeding position, each of said removal mechanisms including a retractable alignment stop adapted to stop the removed sheet during its free fall to said feed position, and each of said removal mechanism including a transport device adapted to introduce said sheet from said feed position into the printer; each of the removal mechanisms comprising a cam controlling the drive of the separation means, the positioning of the retractable alignment stop and the activation of the transport device; a drive wheel connected by a gear to the drive of the platen of the printer and a selection mechanism adapted to activate one of the removal mechanisms, each of said removal mechanisms including a control part for holding the cam against the biasing force of a spring in a rest position separated from the drive wheel, the control part having a portion engageable with the selection mechanism for releasing said cam from the rest position, whereby the cam engages the drive wheel.

2. A device according to claim 1, wherein the separation means comprise an operating lever mounted on a shaft fastened to the frame, a first end of said lever engaging an operating rod actuated by the cam and the second end of the operating lever having teeth engaging a toothed wheel fixed to said roller means, said roller means being carried by two brackets mounted to rotate on said shaft fastened to the frame, a first spring connecting the operating lever to one of the brackets, and a second spring connecting the operating lever to the frame so that a rotation of the operating lever around said shaft in a first direction puts the roller means in contact with the top sheet of the stack and drives the roller means to move the sheet in the first direction, and a rotation of the operating lever in the opposite direction drives the sheet by said roller means in the opposite direction and disengages roller means from the sheet.

3. Device according to claim 2, wherein each of the alignment stops is mounted to rotate on the frame and connected to said operating rod to be positioned to stop the sheet in its free fall toward the feed position, each of the cams being made to retract the alignment stop, when the sheet engages the transport device.

4. Device according to claims 2 or 3, wherein each of the transport devices comprises two rollers, one being mounted to rotate on the frame and driven by a gear by the drive of the platen of the printer, the other roller being mounted on said operating lever to be pulled by said second spring against said one roller.

5. A device according to claim 2, in which the drive wheel is a toothed wheel, wherein each of the cams comprises teeth on a first portion of its periphery adapted to engage the toothed wheel to allow the positioning of the alignment stop and the rotation of the operating lever in a first direction against the action of the first and second springs, and a smooth surface on a second portion of the cam periphery for the operating lever to rotate in the opposite direction under the action of the first spring to return to its rest position by putting the two rollers of the transport device in contact and by retracting the alignment stop.

6. A device according to claim 1, comprising two supports for storing printed sheets, wherein a wall separating the two supports is mounted to be able to move from a first position, in which it guides the printed sheets on one support where they are stacked in normal order, to a second position in which the sheets are directed on the other support where they are stacked in reverse order.

7. A device according to claim 6, wherein said other support for storing printed sheets comprises a mechanism for removal of an envelope from a stack of envelopes to be printed that are stored on this support and a channel suitable for guiding said envelope into the printer.

8. A device according to claim 7, wherein said other support is provided with an element intended to hold envelopes to be printed, this element being adapted to obstruct said channel, when no envelope to be printed is placed on the other support.

9. A device according to claim 1, wherein the separation means comprise an operating lever mounted on a shaft fastened to the frame, a first end of said lever engaging an operating rod actuated by the cam and the second end of the operating lever being coupled to said roller means so that a rotation of the operating lever around said shaft in a first direction puts the roller means in contact with the top sheet of the stack and drives the roller means to move the sheet in the first direction, and a rotation of the operating lever in the opposite direction drives the sheet by said roller means in the opposite direction and disengages said roller means from the sheet.

10. A device according to claim 2 wherein each of the alignment stops is mounted to rotate on the frame and connected to said operating rod to be positioned to stop the sheet in its free fall toward the feed position, each of the cams being made to retract the alignment stop, when the sheet engages the transport device.

11. A device according to claims 2 or 3, wherein each of the transport devices comprises two rollers, one being mounted to rotate on the frame and driven by a gear by the drive of the platen of the printer, the other roller being connected to said operating lever to be pulled against the stationary roller.

12. A device according to claim 11, in which the drive wheel is a toothed wheel, wherein each of the cams comprises teeth on a first portion of its periphery adapted to engage the toothed wheel to allow the positioning of the alignment stop and the rotation of the operating lever in a first direction against the action of spring means, and a smooth surface on a second portion of the cam periphery for the operating lever to rotate in the opposite direction under the action of said spring means to return to its rest position by putting the two rollers of the transport device in contact and by retracting the alignment stop.

13. An individual sheet feed device for a printer or typewriter, comprising supports carrying stacks of sheets, said supports having holding elements for holding the sheets in substantially vertical stacks, a removal mechanism associated with each of said supports, said removal mechanism adapted to remove a sheet from the stack and to positively drive the removed sheet to a position for feeding said sheet into the printer, said removal mechanism including separation means for the top sheet of the stack having roller means adapted to engage and move said sheet by friction in a first direction against gravity to disengage said sheet from said holding elements and to positively drive the removed sheet in a second direction opposite the first over the holding elements to a position for feeding the sheet to a printer, said separation means being disengageable from said sheet allowin free fall of the sheet to said feeding position, each of said removal mechanisms including a retractable alignment stop adapted to stop the removed sheet during its free fall to said feed position, and each of said removal mechanisms including a transport device adapted to introduce said sheet from said feed position into the printer; each of the removal mechanisms comprising a single cam controlling (a) the drive of the separation means, (b) the positioning of the retractable alignment stop and (c) the activation of the transport device.

* * * * *